US006695707B1

(12) United States Patent
Fernandez et al.

(10) Patent No.: US 6,695,707 B1
(45) Date of Patent: Feb. 24, 2004

(54) AMUSEMENT RAMP STRUCTURE

(76) Inventors: Alexander H. Fernandez, 454 Martelo Ave., Pasadena, CA (US) 91107; Mario M. Sanchez-Laky, 454 Martelo Ave., Pasadena, CA (US) 91107

( * ) Notice: Subject to any disclaimer, the term of this patent is extended or adjusted under 35 U.S.C. 154(b) by 0 days.

(21) Appl. No.: 10/392,168

(22) Filed: Mar. 19, 2003

(51) Int. Cl.[7] ..... A63C 19/10
(52) U.S. Cl. ..... 472/89; 14/69.5
(58) Field of Search ..... 472/88, 89, 90; 14/2.4, 2.5, 69.5

(56) References Cited

U.S. PATENT DOCUMENTS 2,927,396 A * 3/1960 Hall, Jr. ..... 446/115
3,811,147 A * 5/1974 Dix ..... 14/2.4
3,863,895 A * 2/1975 Grewe et al. ..... 254/88
4,129,916 A * 12/1978 Schlesinger et al. ..... 14/69.5
4,864,672 A * 9/1989 Altieri et al. ..... 14/69.5
4,913,615 A * 4/1990 Ward ..... 414/537
5,457,836 A * 10/1995 Wiedeck ..... 14/2.4
5,524,310 A * 6/1996 Farnen ..... 14/69.5
5,870,788 A * 2/1999 Witkin ..... 14/69.5
5,890,948 A * 4/1999 Nilsson ..... 446/476
6,042,480 A 3/2000 Labelson
6,350,174 B1 * 2/2002 Halford et al. ..... 446/444

OTHER PUBLICATIONS

Ramps.com—Internet Home Page.

* cited by examiner

*Primary Examiner*—Kien T. Nguyen
(74) *Attorney, Agent, or Firm*—Jack C. Munro

(57) ABSTRACT

An amusement ramp structure usable in conjunction with a wheeled vehicle which takes the form of a ramp that has an arcuate outer surface. The lower edge of the ramp is adapted to be located directly against a supporting surface. Attached to an upper edge of the ramp is a deck with this deck being movable from a horizontal position to a vertical position so that the ramp structure can be placed in two different configurations of usage. The deck is mounted on a deck frame with this deck frame being separatable into two parts in order to collapse the ramp structure to occupy a minimum amount of space to facilitate storage.

9 Claims, 3 Drawing Sheets

AMUSEMENT RAMP STRUCTURE

BACKGROUND OF THE INVENTION

1. Field of the Invention

The present invention relates to a ramp structure that is to be usable to provide aerial lift and interaction for grinding maneuvers (not just a kicker) for humans on skateboards, bicycles, in-line skates and other types of wheeled vehicles and more particularly to a ramp structure that can be placed in different configurations of usage and also can be collapsed to minimize the amount of space that the ramp structure occupies when the ramp structure is being stored.

2. Description of the Related Art

The ramp structure of this invention is going to be described in relation principally to a skateboard. However, it is considered to be within the scope of this invention that the ramp structure could be used with bicycles, in-line skates, scooters as well as other types of wheeled vehicles.

Skateboard enthusiasts, within the past few years, have taken skateboarding to include grinding maneuvers and aerial acrobatics. To perform these aerial acrobatics, there is required some type of a structure upon which the skateboard is to be operated. One type of structure is commonly known as a "half pipe". The skateboarder is to maneuver himself or herself back and forth across the internal surface of the half pipe when performing the grinding maneuvers and aerial acrobatics. However, there are other types of structures other than half pipes that are enjoyed by skateboarders. One type of structure is known as a rail where the skateboarder pops up (an ollie) onto the rail and maneuvers along the rail for a period of time and then hops off the rail. Another type of structure would be a ramp that is to simulate a portion of a half pipe, such as a "quarter pipe".

In the past, there have been constructed ramps that are to be used by skateboarders. However, these ramps principally are constructed of a solid configuration and form a concave exterior surface upon which the skateboard is to be ridden. At the upper edge of the ramp, there may be included a planar horizontal surface which is termed a deck. One of the disadvantages to these prior art types of ramps is that such only has one configuration of usage. Another disadvantage is that the ramps are not disassemblable so that the ramps occupy a maximum amount of space even when the ramps are not being used. This makes it difficult to easily store such ramps in one's garage or storage facility.

SUMMARY OF THE INVENTION

The structure of this invention is to have as one objective a ramp which is sturdy and which can be easily collapsed for transportation and/or storage.

Another objective of the present invention is to construct a ramp which can be positioned next to another one of the same or different ramps (or other structure) so that such may be joined (via hardware) to form a compound structure that offers additional opportunity for aerial acrobatics or grinding maneuvers.

Another objective of the present invention is to construct a ramp which can be placed in multiple configurations of usage which will provide to the user a greater degree of interest over a longer period of time.

The basic embodiment of amusement ramp structure of the present invention utilizes a ramp that has an arcuate outer surface with the ramp having an upper edge and a lower edge. The lower edge is adapted to be placed against a supporting surface with the upper edge being spaced from the supporting surface. A deck, which has a substantially planar exterior surface, is to be mounted to the upper edge of the ramp. The deck is movable relative to the ramp between a horizontally oriented position and a vertically oriented position. A supporting leg structure is fixedly attached to the deck with the supporting leg structure adapted to rest on the supporting surface when the ramp is in the horizontally oriented position. The supporting leg structure functions to support the deck.

A further embodiment of the present invention is where the basic embodiment is modified by the arcuate outer surface being concave in configuration.

A further embodiment of the present invention is where the basic embodiment is modified by the deck being pivotally movable relative to the ramp.

A further embodiment of the present invention is where the basic embodiment is modified by the ramp including a base wedge which has a lower planar surface which is to be placed in direct contact with the supporting surface and the base wedge also having in longitudinal cross-sectional triangular configuration.

A further embodiment of the present invention is where the basic embodiment is modified by the deck being separatable into two parts and when separated the ramp structure is collapsed to occupy a minimum amount of space to facilitate storage.

A further embodiment of the present invention is where the just previous embodiment is modified by the two parts of the deck being connected together in a telescoping manner.

A further embodiment of the present invention is where the basic embodiment is modified to include bracing connected between deck and the ramp. The bracing defines a limit of movement of the ramp when in the horizontally oriented position.

A further embodiment of the present invention is where the just previous embodiment is modified by the bracing comprising a flexible webbing.

A further embodiment of the present invention is where the just previous embodiment is modified by the flexible webbing taking the form of a series of straps.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
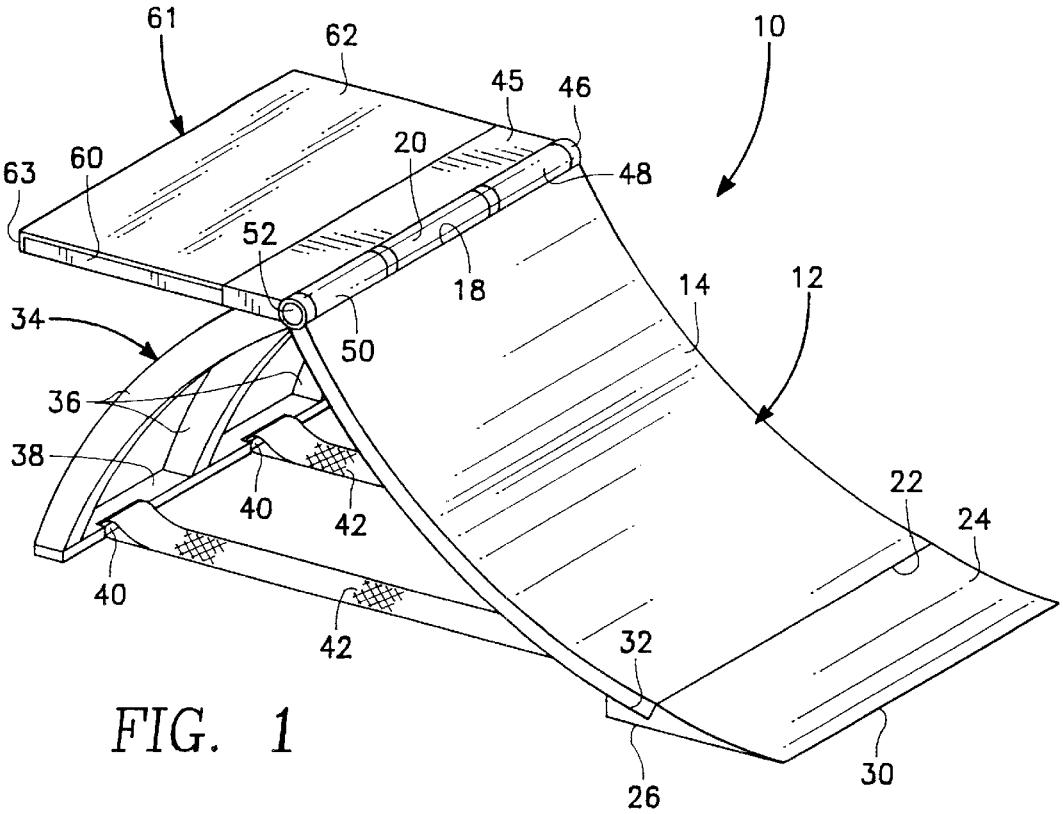
FIG. 1 is a left side/frontal view of the ramp structure of the present invention showing the ramp structure in a first configuration of usage.

Referring particularly to the drawings, there is shown the ramp structure 10 of this invention. The ramp structure 10 includes a sheet material ramp 12 which will normally be constructed of plastic, fiberglass, metal or wood material. The ramp structure 10 has an outer surface 14 which preferably will be concave. The inner surface of the ramp 12 is fixedly mounted to a series of brace members 16 which are mounted in a crossed relationship. It is the function of the brace members 16 to provide strength to the ramp 12.

Fixedly mounted to the upper edge 18 of the ramp 12 is a center tube 20. The center tube 20 is centrally disposed on the upper edge 18. Mounted against the lower edge 22 of the ramp 12 is a base wedge 24 which is part of the ramp structure. The base wedge 24 constitutes a strip of material that is precisely the same width as the ramp 12. The base wedge 24 is basically triangular shaped in configuration and forms a planar bottom 26. The planar bottom 26 is to rest against the supporting surface 28. A typical supporting surface 28 would be a cement or asphalt driveway or patio, or could comprise a floor of a building structure. It is to be noted that the outer free edge 30 of the base wedge 24 is exceedingly narrow and is essentially flat with the supporting surface 28. The base wedge 24 includes an elongated indentation 32. The lower edge 22 of the ramp 12 physically connects with the indentation 32. This connection can be in the form of an adhesive or could be by means of fasteners, such as screws or bolts. The base wedge 24 could be removable and another structure, such as a ground sheet, could be placed in conjunction with the ramp structure.

A support leg structure 34 has three in number of spaced apart legs 36. The number of the support legs 36 can be increased or decreased without departing from the scope of this invention. The support leg structure 34 has a foot plate 38. The foot plate 38 is fixedly connected between each of the support legs 36. The foot plate 38 includes a pair of spaced apart slots 40. Each of the slots 40 are to connect with a webbing strap 42. The opposite end of each of the webbing straps 42 is to be fixedly connected with a slot 41 formed on an inside surface of the base wedge 24.

The support leg structure 34 has an upper plate 44. The upper end of each of the support legs 36 is fixedly mounted to the upper plate 44. The upper plate 44 has an upper planar surface. Positioned at the upper plate 44 are a plurality of plastic rings 46. There are shown four in number of the rings 46 located in a spaced apart manner. These rings 46 are separate from the upper plate 44. Each of the rings 46 have a through hole 47 with the through holes of a pair of the rings 46 to be in alignment with the through passage 21 through of the center tube 20. This will place a ring 46 at each end of the center tube 20 with the diameter of each through hole 47 being of the same diameter as the through passage 21.

Located in alignment with the through passage 21 and the through holes 47 is a pair of side tubes 48 and 50. A rod 52 is then to be conducted through the aligned holes of the rings 46 and also to be conducted through the aligned through passages 49 and 51 of the respective side tubes 48 and 50 and the through passage 21 of the center tube 20. This, in essence, provides a hinge type connection that permits pivoting of the deck plate 45 relative to the ramp 12 since the deck plate 45 is fixedly mounted onto a deck plate frame that is composed of an elongated bar 54 and three in number of short tubes 56 which are fixed onto upper plate 44. The combined length of side tubes 48 and 50 is to equal the length of center tube 20 in order to prevent any twisting of the overall structure. The length of side tube 48 is equal to the length of side tube 50. Each short tube 56 has an open end that provides access into an internal passage within the short tube 56. Within the internal passage of each short tube 56 there is to be telescopingly located a connecting bar 58 with it being understood that there is a separate connecting bar 58 for each short tube 56. Each connecting bar 58 is fixedly mounted to a brace 60 with it being understood that there are three in number of the braces 60. Fixedly mounted onto the brace 60 is a deck 62. The deck 62 has an upper planar surface that is located flush to the upper planar surface of a deck plate 45. The deck 62 is to be located abuttingly against the deck plate 45. Deck 62 has an end flange 63 that abuts against the outer end of braces 60.

Figure 2:
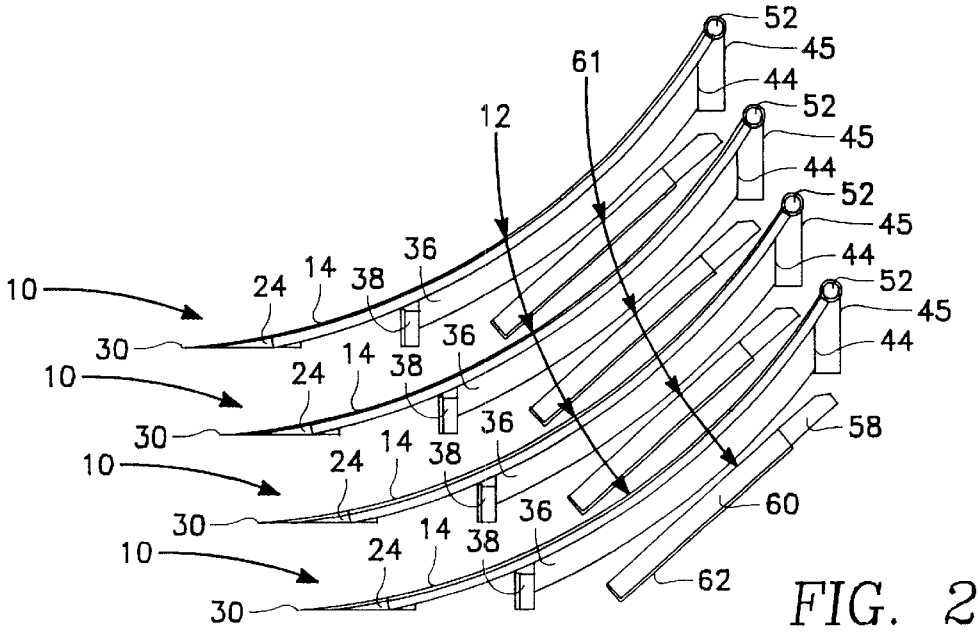
FIG. 2 is a side view of a plurality of the ramp structures which are located in disassembled configurations and stacked together to occupy a minimum amount of space during storage.

The deck 62, which includes braces 60 and the connecting bars 58, can be manually disengaged from the elongated bar 54 and the short tubes 56. This will permit the deck 62 as well as the two secured members to be located in juxtaposition with the ramp 12, as is clearly shown in FIG. 2. This will permit the ramp structure 10 to be partially disassembled so as to facilitate storage and actually a plurality of the ramp structures 10 can be stored in a stacked relationship, as is shown in FIG. 2, occupying a minimum amount of space.

Figure 3:
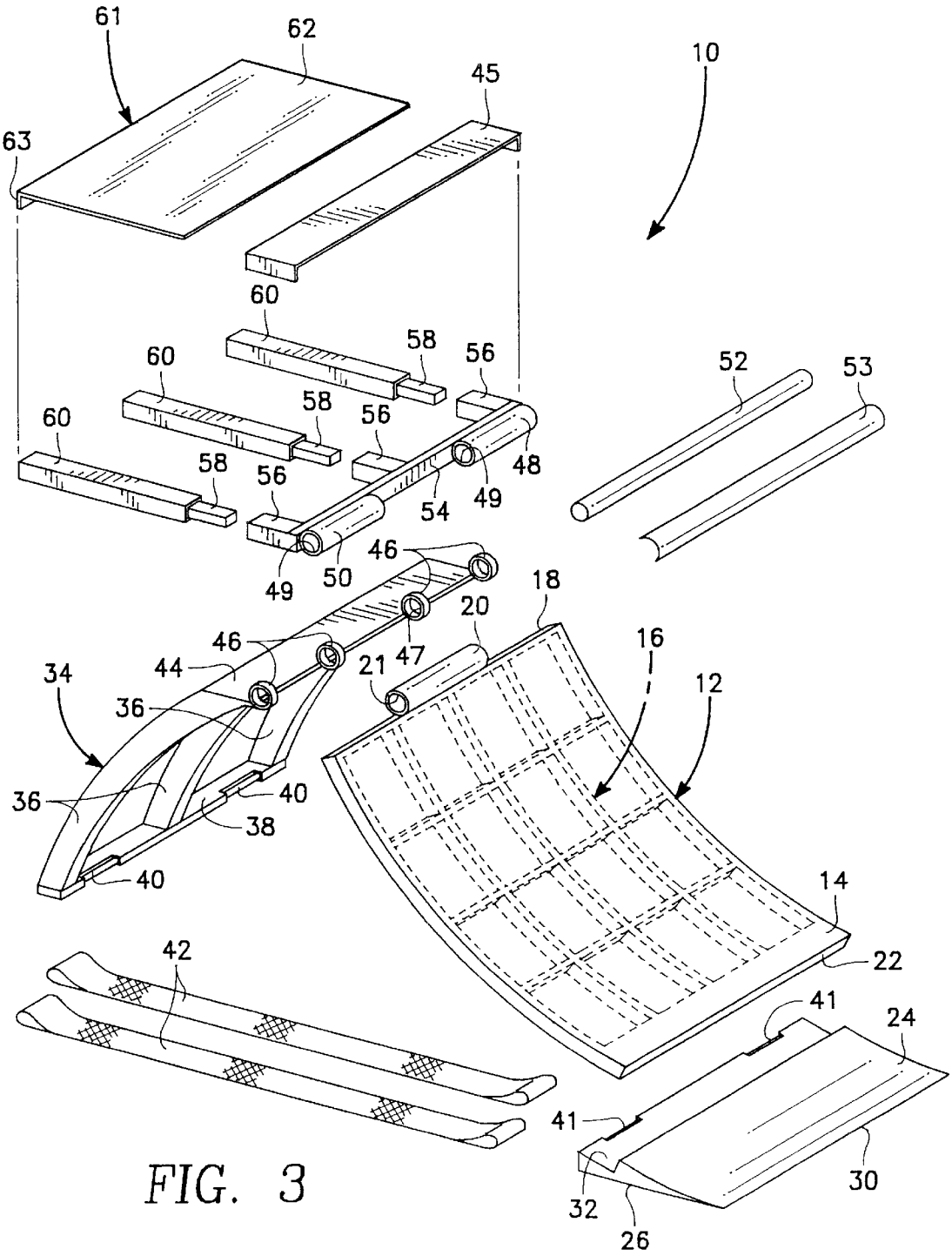
FIG. 3 is an exploded isometric view of the ramp structure of the present invention.
Figure 4:
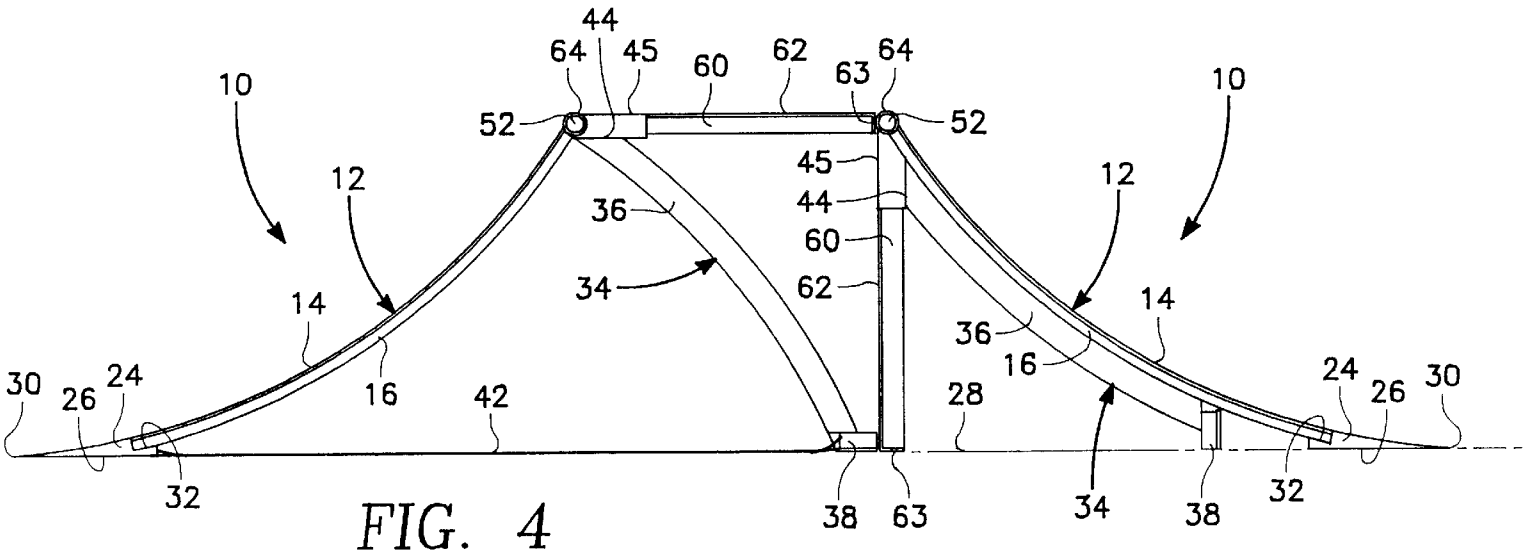
FIG. 4 is a side elevational view showing the mounting of two of the ramp structures together with one ramp structure being in one (quarter pipe) configuration and the second ramp structure being in another (spine) configuration of usage.

The support leg structure 34 can be pivoted from a position substantially abutting against the undersurface of the ramp 12 to an outwardly extended position, which is clearly shown in FIGS. 1, 3 and 4. In this outwardly extended position, the webbing straps 42 will be stretched taut. The foot plate 38 will be resting against the supporting surface 28 and the upper planar surface of the deck 62 and the deck plates 44 will be located substantially horizontal and parallel to the supporting surface 28. This is defined as a first usage configuration where a user, such as a skateboard enthusiast, can be able to propel himself or herself up the outer surface 14 and land on the deck 62 or the deck plate 45.

In a second configuration, the supporting leg structure 34 can be located directly adjacent the brace members 16. This will locate the deck 62 substantially vertical, ninety degrees displaced from the position shown in FIG. 1 with end flange 63 located on the supporting surface. With the ramp structure 10 used in this position, the user can propel herself or himself up the outer surface 14 and fly exteriorly and off the ramp structure 10 or can come down (grind) against the spine 64 which is composed of cover 53 and tubes 20, 48, and 50 and the rings 46. The tubes 20, 48 and 50 may be covered with a slide-on or snap-on coping 53 to provide a perfectly smooth surface for the spine. This may be attached via adhesive or a nut and bolt hardware.

Referring particularly to FIG. 4, there is shown a ramp structure 10 that is located in the first configuration adjoined with a ramp structure 10 that is located in the second configuration.

Figure 5:
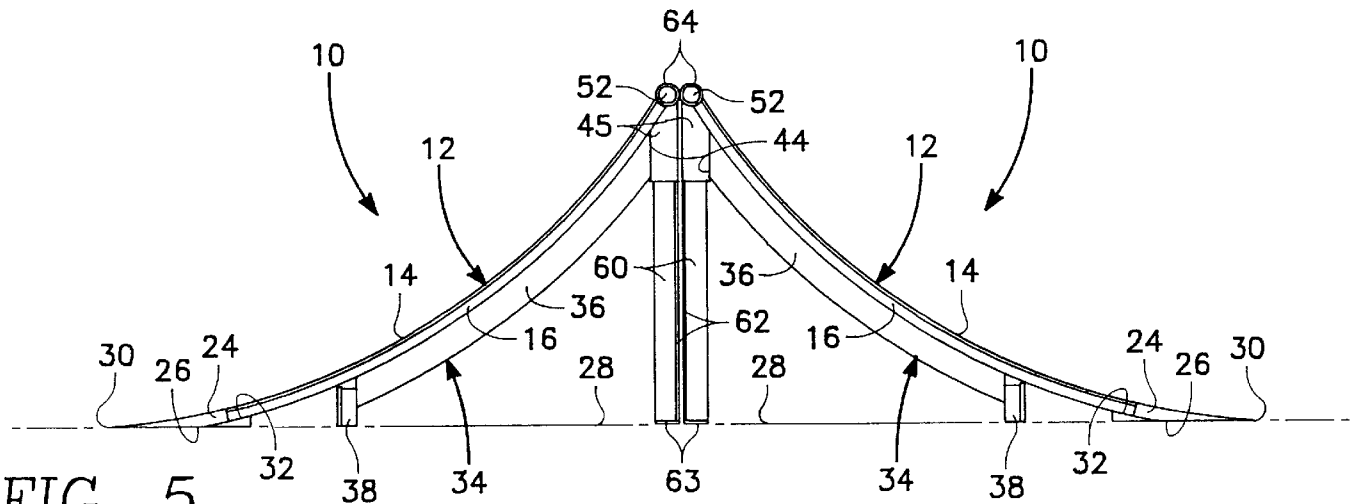
FIG. 5 is a side elevational view of two ramp structures which are placed abutting each other with each ramp structure being in the spine configuration of usage where the two ramp structures cooperate to form a further configuration of usage.

Referring particularly to FIG. 5, there are two ramp structures 10 that are abutting each other in the second configuration with the result that the spine 64 is of double width.

There may be added a guard rail that interconnects between the foot plate 38 and the deck 62. The guard rail will extend above the surface of the deck 62. The guard rail is to provide protection against a user inadvertently falling off the deck 62 as well as adding additional structural bracing to the deck 62 to keep the deck 62 from deflecting when a user is located on the deck 62.

What is claimed is:

1. An amusement ramp structure usable in conjunction with a wheeled vehicle comprising:

a ramp structure having an arcuate outer surface, said ramp structure having an upper edge and a lower edge, said lower edge adapted to be placed against a supporting surface with said upper edge being spaced from the supporting surface;

a deck having a substantially planar exterior surface, said deck being mounted to said upper edge of said ramp structure, said deck being movable relative to said ramp structure between a first position and a second position, when in said first position said planar exterior surface adapted to be located horizontal and when in said second position said planar exterior surface adapted to be located vertical; and a supporting leg structure fixedly attached to said deck, said supporting leg structure adapted to rest on the supporting surface when said ramp structure is in said first position, said supporting structure supporting said deck.

2. The amusement ramp structure as defined in claim 1 wherein:

said arcuate outer surface being concave.

3. The amusement ramp structure as defined in claim 1 wherein:

said deck being pivotally movable relative to said ramp structure.

4. The amusement ramp structure as defined in claim 1 wherein:

said ramp structure including a base wedge, said base wedge having a planar lower surface which is adapted to rest against the supporting surface, said base edge being mounted at said lower edge of said ramp structure, said base edge in longitudinal cross-section being substantially triangular, said base wedge having an upper surface which is adapted to be flush with said arcuate outer surface of a ramp of said ramp structure.

5. The amusement ramp structure as defined in claim 1 wherein:

said deck being separatable into two parts and when separated said ramp structure is collapsed to occupy a minimum amount of space to facilitate storage.

6. The amusement ramp structure as defined in claim 5 wherein:

said two parts being telescopingly interconnected together.

7. The amusement ramp structure as defined in claim 1 wherein:

there being bracing connected between said supporting leg structure and said ramp structure, said bracing defining the limited movement of said ramp structure when in said first position.

8. The amusement ramp structure as defined in claim 7 wherein:

said bracing comprising a flexible webbing.

9. The amusement ramp structure as defined in claim 8 wherein:

said flexible webbing comprising a series of straps.

* * * * *